United States Patent [19]

Huang et al.

[11] Patent Number: 4,710,247

[45] Date of Patent: Dec. 1, 1987

[54] RAPIDLY SOLIDIFIED TRI-NICKEL ALUMINIDE BASE ALLOY

[75] Inventors: Shyh-Chin Huang, Latham; Keh-Minn Chang; Alan I. Taub, both of Schenectady, all of N.Y.

[73] Assignee: General Electric Company, Schenectady, N.Y.

[21] Appl. No.: 839,659

[22] Filed: Mar. 14, 1986

Related U.S. Application Data

[62] Division of Ser. No. 647,326, Sep. 4, 1984, abandoned.

[51] Int. Cl.[4] ..... C22C 19/00

[52] U.S. Cl. ..... 148/429; 420/460

[58] Field of Search ..... 148/403, 429; 470/460, 470/441

[56] References Cited

U.S. PATENT DOCUMENTS

| | | | |
|---|---|---|---|
| 3,922,168 | 11/1975 | Restall et al. | 75/171 |
| 4,318,756 | 3/1982 | Bibring et al. | 148/32.5 |
| 4,359,352 | 11/1982 | Ray et al. | 148/31 |
| 4,478,791 | 10/1984 | Huang et al. | 420/590 |

FOREIGN PATENT DOCUMENTS

| | | | |
|---|---|---|---|
| 2037322 | 7/1980 | United Kingdom | 420/460 |

OTHER PUBLICATIONS

C. T. Liu & C. C. Koch, "Development of Ductile Polycrystalline $Ni_3Al$ for High-Temperature Applications", Technical Aspects of Critical Materials Use by the Steel Industry, NBSIR 83-2679-2, vol. IIB, Jun. 1983, Center for Materials Science, U.S. Dept. of Commerce, National Bureau of Standards.

C. T. Liu, C. L. White, C. C. Koch, & E. H. Lee, "Preparation of Ductile Nickel Aluminides for High Temperature Use", Proc. Electrochemical Soc. on High Temp. Mat., Ed. M. Cubicciotti, vol. 83-7, Electrochemical Society Inc. (1983), p. 32.

*Primary Examiner*—Christopher W. Brody

*Attorney, Agent, or Firm*—Paul E. Rochford; James C. Davis, Jr.; Paul R. Webb, II

[57] ABSTRACT

A method for achieving both improved strength and improved ductility in intermediate phases is provided. The method, briefly stated, comprises the steps of providing a melt whose composition substantially corresponds to that of a preselected intermetallic phase having a crystal structure of the $Ll_2$ type, such as nickel alumininde, modified with from about 0.01 to 2.5 atomic percent boron, and modified further with cobalt substituent metal and rapidly solidifying the melt at a cooling rate of at least about $10^{3°}$ C./second to form a solid body, the principal phase of which is of the $Ll_2$ type crystal structure in either its ordered or disordered state.

10 Claims, 3 Drawing Figures

RAPIDLY SOLIDIFIED TRI-NICKEL ALUMINIDE BASE ALLOY

This application is a division, of application Ser. No. 647,326, filed Sept. 4, 1984 now abandoned.

BACKGROUND OF THE INVENTION

By a previous application the inventors disclosed and claimed a set of alloys having a boron additive which made possible the achievement of a novel combination of strength and ductility in certain compositions. That application, Ser. No. 444,932 filed Nov. 29, 1982 now U.S. Pat. No. 4,478,791, was assigned to the same assignee as the subject application and is incorporated herein by reference.

It is pointed out in the prior application that in many systems composed of two or more metallic elements there may appear, under certain combinations of composition and treatment conditions, phases other than the primary solid solutions. Such other phases are commonly known as intermediate phases. Many intermediate phases are referred to by means of the Greek symbol such as $\gamma$ or $\gamma'$. Also, they are preferred to by formula as, for example, $Cu_3Al$, CuZn and $Mg_2Pb$. The compositions of the intermediate phases which have simple approximate stoichiometric ratios of the elements may exist over a range of temperatures as well as compositions.

Occasionally, as in the case of $Mg_2Pb$, which occurs in the Mg-Pb system, a true stoichiometric compound, which compound is completely ordered, is found to occur. Where each of the elements of the compound is a metallic element, the intermediate compound itself is commonly called an intermetallic compound.

The intermediate phases and intermetallic compounds often exhibit properties entirely different from those of the component metals comprising the system. They also frequently have complex crystallographic structures. The lower order of crystal symmetry and fewer planes of dense atomic population of these complex crystallographic structures may be associated with certain differences in properties, e.g. greater hardness, lower ductility, lower electrical conductivity of the intermediate phases as compared to the properties of the primary solid solutions.

Although several intermediate intermetallic compounds with otherwise desirable properties, e.g. hardness, strength, stability and resistance to oxidation and corrosion at elevated temperatures, have been identified, their characteristic lack of ductility has posed formidable barriers to their use as structural materials. In fact, some of these materials are so friable that they have been prepared as solids in order that they may be broken up into powdered form for use in powder metallurgical processes for fabrication of articles.

A recent article appearing in the Japanese literature disclosed that the addition of trace amounts (0.05 to 0.1 wt. %) of boron to $Ni_3Al$ polycrystalline material was successful in improving the ductility of the otherwise brittle and non-ductile intermetallic compound. See in this regard *Journal of the Japan Institute of Metals,* Vol. 43, page 358, published in 1979 by the authors Aoki and Izumi. Although the room temperature tensile strain to fracture of the $Ni_3Al$ was improved by the boron addition to about 35%, as compared to about 3% for the $Ni_3Al$ without boron, the room temperature yield strength remained at about 30 ksi. The Japanese article did not refer at all, however, to rapid solidification of the boron containing compositions which they studied.

By the method of the prior application for Ser. No. 444,932, filed Nov. 29, 1982 now U.S. Pat. No. 4,478,791, the addition of 0.01 to 2.5 at. % boron demonstrated further improvements where the alloy preparation included the step of rapid solidification. In particular, as it is brought out in this prior application, preferred properties are found in rapidly solidified compositions containing between 0.5 and 2.0% boron and an optimum combination of yield stress and strain to fracture is found in rapidly solidified compositions containing approximately 1.0% boron or less.

Surprisingly, it has now been found that further property improvements are possible in the alloy system of the gamma prime $Ni_3Al$ intermediate phase where not only boron is present in the composition as a ternary element but in addition a metal is present as a quaternary ingredient of such compositions as a substituent metal.

BRIEF STATEMENT OF THE INVENTION

It is, accordingly, one object of the present invention to provide an improved alloy for operation at higher temperatures.

Another object is to provide an alloy of nickel and aluminum capable of operating at elevated temperatures for sustained periods of time.

Another object is to provide a nickel aluminum alloy having an $L1_2$ type crystal structure but having significant ductility and strength.

Another object is to provide an alloy of aluminum and nickel in which cobalt is substituted for a portion of the nickel and which has a unique combination of physical properties.

Other objects and advantages of the present invention will be in part apparent and in part pointed out in the description which follows.

In one of its broader aspects, objects of the invention can be achieved by providing a rapidly solidified alloy composition having an $L1_2$ crystal structure and having a composition $$(Ni_{0.75-x}Co_xAl_{0.25})_yB_{100-y},$$

where x is from 0.025 to 0.15, and y is from 97.5 to 99.9.

BRIEF DESCRIPTION OF THE FIGURES

The present invention and the description which follows will be made clearer by reference to the accompanying figures in which.

DETAILED DESCRIPTION OF THE INVENTION

Figure 1:
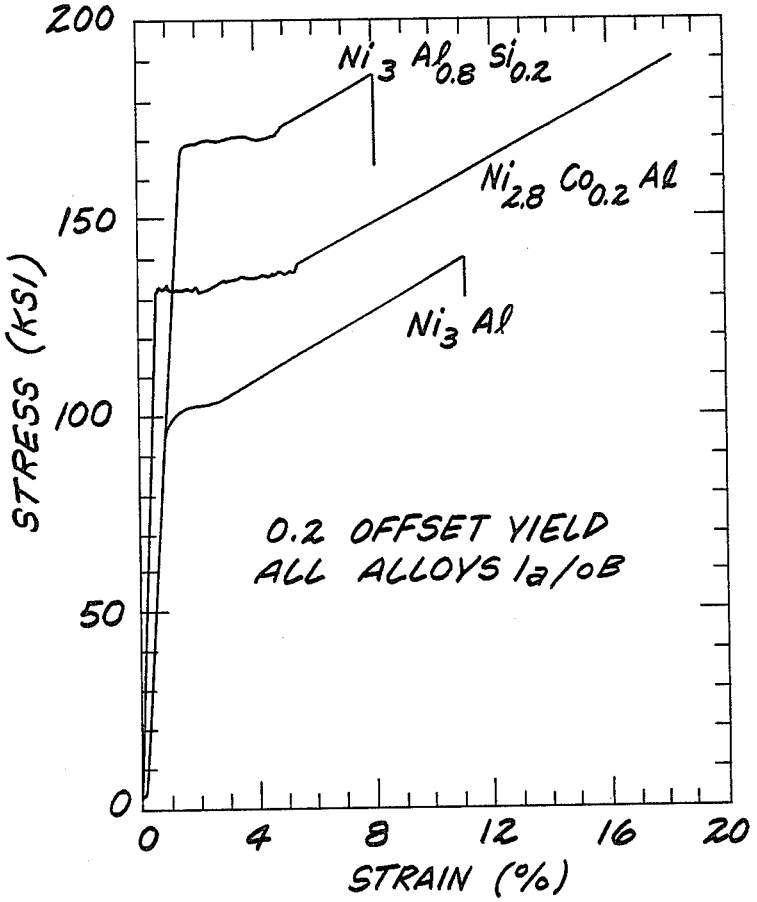
FIG. 1 is a plot of the values of the stress of the inventive alloys plotted against the strain in percent for the base $Ni_3Al$ alloy as well as alloys containing substituents for the nickel and aluminum constituents.

By a substituent metal is meant a metal which takes the place of and in this way is substituted for another and different ingredient metal, where the other ingredient metal is part of a desirable combination of ingredient metals which ingredient metals form the essential constituent of an alloy system.

For example, in the case of the superalloy system $Ni_3Al$ or nickel base superalloy, the ingredient or constituent metals are nickel and aluminum. The metals are present in the stoichiometric atomic ratio of 3 nickel atoms for each aluminum atom in this system.

It has been known heretofore that a desirable crystal form and accompanying superior physical properties can be achieved by forming a single crystal of $Ni_3Al$. However, polycrystalline $Ni_3Al$ is quite brittle and shatters under stress such as applied in efforts to form the material into useful objects or to use such an article.

It was discovered that the inclusion of boron in the rapidly cooled and solidified alloy system can impart desirable ductility to the rapidly solidified alloy as taught in application Ser. No. 444,932 referred to above.

Now it has been discovered that a certain metal can be beneficially substituted in part for the constituent metal nickel and hence this substituted metal is designated and known herein as a substituent metal, i.e. as a nickel substituent in the $Ni_3Al$ structure. Moreover, it has been discovered that valuable and beneficial properties are imparted to the rapidly solidified compositions which have the stoichiometric proportions but which have a substituent metal as a quaternary ingredient of such rapidly solidified alloy system.

The alloy compositions of the present invention must also contain boron as a tertiary ingredient as taught herein and as taught in copending application Ser. No. 444,932 referred to above, and must further contain a quaternary component or ingredient as taught in the subject specification.

The composition which is formed must have a preselected intermetallic phase having a crystal structure of the $L1_2$ type and must have been formed by cooling a melt at a cooling rate of at least about $10^{3°}$ C. per second to form a solid body the principal phase of which is of the $L1_2$ type crystal structure in either its ordered or disordered state. The melt composition from which the structure is formed must have the first constituent and second constituent present in the melt in an atomic ratio of approximately 3:1.

As pointed out in the prior application Ser. No. 444,932, referred to above, compositions having this combination of ingredients and which are subjected to the rapid solidification technique have surprisingly high values for both the strain to fracture after yield and for the 0.2% offset yield stress. For boron levels between 1 and 2% the values of the strain to fracture generally declines so that a preferred range for the boron tertiary additive is between 0.5 and 1.5%.

By the prior teaching of application Ser. No. 444,932, it was found that the optimum boron addition was in the range of 1 atomic percent and permitted a yield strength value at room temperature of about 100 ksi to be achieved for the rapidly solidified product. The fracture strain of such a product was about 10% at room temperature.

Surprisingly, it has now been found that the unusual strength properties which are obtained through the use of the rapid solidification in combination with the boron additive may be increased to heretofore unprecedented levels with the addition of a selected quaternary component or ingredient as a substituent to the primary nickel constituent.

The quaternary ingredient which may be beneficially included in a composition for rapid solidification as a substituent to make unprecedented improvements in the aluminide properties is the element cobalt.

Further, it has been observed that in the case where an equiaxed structure is formed with the quaternary composition of nickel, aluminum, boron and cobalt, by rapid solidification, the properties of the composition are substantially better on the average than in those cases where the non-equiaxed structure is formed. The equiaxed structure is believed to result from recrystallization. It is known that recrystallization can readily occur in a single-phase material.

The addition of the cobalt as quaternary ingredient and as a substituent for nickel at about a 5 atomic percent level apparently does not form borides or beta phases under the influence of the rapid solidification process.

Regarding the improved properties achieved, the measurements made following the preparation of the alloys and the testing of alloys as described herein has yielded some surprising results. One set of the properties and particularly the tensile strength properties are indicated in the attached FIG. 1 in which the stress in ksi is plotted against the strain in percent.

It is evident from FIG. 1 that the alloy contraining the tri-nickel aluminide labelled $Ni_3Al$ with 1% boron has the lowest stress values and that the two other samples which were tested had significantly and unexpectedly higher values. The sample with about 5 atomic percent silicon had the highest stress values found and these were of the order of 185 ksi. However, the same sample had lower strain and failed at a lower value than the value measured for the tri-nickel aluminide itself. The boron doped nickel aluminide having the cobalt substituent for nickel was found to have a stress of approximately 130 ksi but had very significantly greater strain capability than that of either the nickel aluminum superalloy itself or of the boron doped nickel aluminide having the silicon substituent for aluminum.

Further study was made of the rapidly solidified compositions containing the substituent cobalt as a quaternary additive. The cobalt additive was a substituent for nickel and the concentration of nickel was decreased as the concentration of cobalt was increased. The concentration of the cobalt was increased as is illustrated in FIG. 2 from $x = 0.05$ to $x = 0.3$ in the expression:

$$(Ni_{0.75-x}Co_xAl_{0.25})_yB_{100-y}.$$

Figure 2:
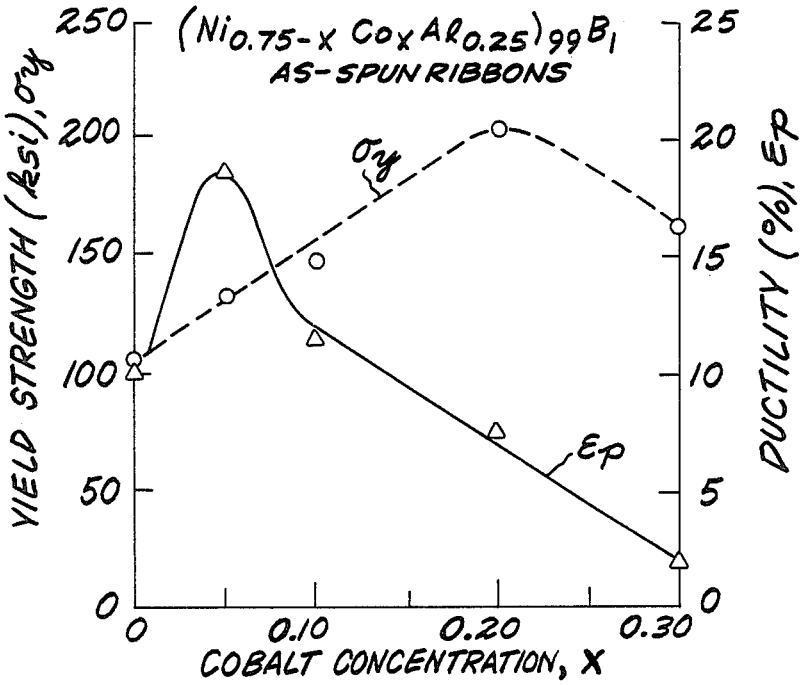
FIG. 2 is a plot showing the variation in yield strength and ductility for different cobalt concentration, x, in as-solidified alloys having the composition $$(Ni_{0.75-x}Co_xAl_{0.25})_{99}B_1.$$

From the plotted data of FIG. 2, it is evident that the yield strength of the quaternary composition containing cobalt as a substituent for nickel increases significantly as the additions of cobalt increased from $x = 0.05$ to 0.10 and then to 0.20. In fact, as is evident from the figure, the yield strength doubles in value at a concentration of cobalt $x = 0.20$ when compared to the composition free of cobalt, i.e. at $x = 0$. Beyond $x = 0.20$ the value of the yield strength decreases thus demonstrating that there is an effective maximum in increasing tensile properties which occurs in the range of about $x = 0.20$ cobalt as a nickel substituent and quaternary additive to the composition containing the boron doped tri-nickel aluminide.

By contrast, the effect of the addition of the cobalt quaternary ingredient on the ductility is illustrated from data plotted in FIG. 2 to peak at a cobalt concentration of approximately $x = 0.05$. Additions of the cobalt at the x =0.05, 0.10, 0.20, and 0.30 levels demonstrated that only in the area of the x =0.05 level did the ductility increase significantly over the boron doped tri-nickel aluminide from which the cobalt was absent (i.e. 0% Co). The percentage increase from x =0 to x =0.05 Co was a surprising 80% for this relatively narrow range of cobalt addition.

The ductility of the samples which had the higher concentrations of cobalt declined to a value at x =0.10 Co which is slightly higher than that at 0% cobalt and to progressively lower values at x =0.20 and x =0.30 as illustrated in FIG. 2.

Figure 3:
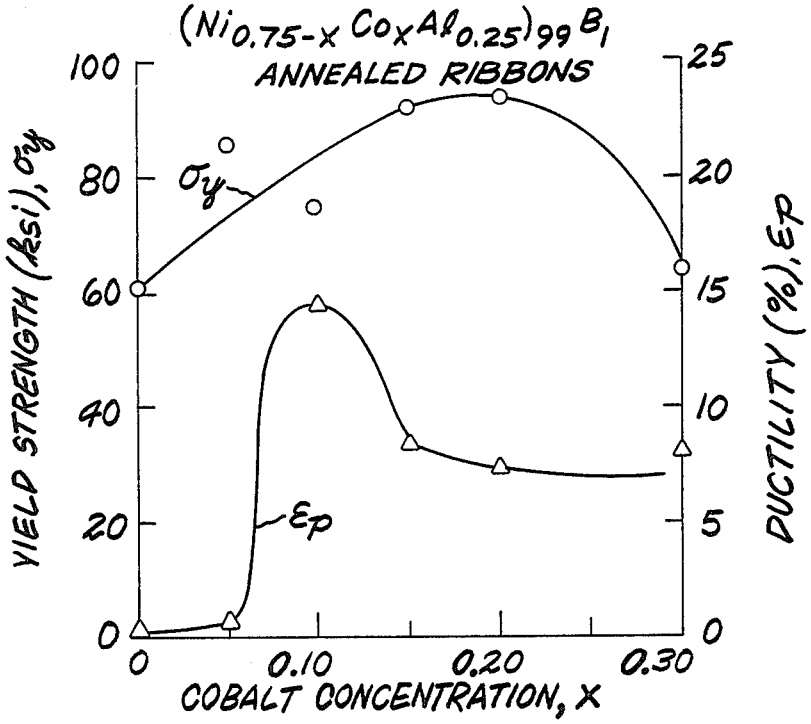
FIG. 3 is a plot similar to that of FIG. 2 but for samples which had been annealed at 1100° C.

With reference now to FIG. 3, there is a plot of data obtained after the ribbon samples which were prepared to contain the x =0.05, 0.10, 0.15, 0.20 and 0.30 cobalt substituent were annealed at 1100° C. for two hours. It may be observed from the data plotted in FIG. 3 that the annealing tended to reduce the overall yield strength relative to those plotted in FIG. 2. The ordinate scale of FIG. 3 is about 40% of that of FIG. 2. The annealed ribbons exhibited a peak in strength for the sample containing the x =20 level of cobalt. This strength maximum occurred at about the same cobalt concentration in the unannealed ribbon as illustrated in FIG. 2.

It will also be noted from the results plotted in FIG. 3 that the ductility value drops off very rapidly between x =0.10 and x =0.05 so that it is necessary to have more than the x =0.05 level of cobalt present as the quaternary additive substituent to avoid the precipitous drop in the annealed ductility which occurs as the concentration of cobalt is reduced below the x =0.10 value.

Based on the results obtained by study of the annealed ribbon as plotted in FIG. 3 the optimum substituent concentration of cobalt for nickel in the boron doped tri-nickel aluminide is approximately x =0.10. At this level, the cobalt quaternary additive resulted in a composition having a yield strength of 80 ksi and ductility of 14% elongation measured for the $Ni_3Al$-based alloy.

It should be emphasized that the data reported in FIGS. 2 and 3 are for tests of ductility and tensile properties which were made at room temperature.

In the practice of this invention, an intermetallic phase having an $L1_2$ type crystal structure is important. It is achieved in alloys of this invention as a result of rapid solidification. It is important that the $L1_2$ type crystal structure be preserved in the products which are annealed for consolidation after rapid solidification.

Nickel aluminide is found in the nickel-aluminum binary system and as the gamma prime phase of conventional gamma/gamma' nickel-base superalloys. Nickel aluminide has high hardness and is stable and resistant to oxidation and corrosion at elevated temperatures which makes it attractive as a potential structural material. Although single crystals of $Ni_3Al$ exhibit good ductility in certain crystallographic orientations, the polycrystalline form, i.e., the form of primary significance from an engineering standpoint, has low ductility and fails in a brittle manner intergrannularly.

Nickel aluminide, which has a face centered cubic (FCC) crystal structure of the $Cu_3Al$ type ($L1_2$ in the Strukturbericht designation which is the designation used herein and in the appended claims) with a lattice parameter $a_o$=3.589 at 75 at. % Ni and melts in the range of from about 1385° to 1395° C., is formed from aluminum and nickel which have melting points of 660° and 1453° C., respectively. Although frequently referred to as $Ni_3Al$, nickel aluminide is an intermetallic phase and not a compound as it exists over a range of compositions as a function of temperature, e.g., about 72.5 to 77 at. % Ni (85.1 to 87.8 wt. %) at 600° C.

In preparing samples pursuant to this invention the selected intermetallic phase is provided as a melt whose composition corresponds to that of the preselected intermetallic phase. The melt composition is made to consist essentially of the two constituent components of the intermetallic phase nickel and aluminum in an atomic ratio of approximately 3:1 and is modified with boron in an amount of from about 0.01 to 2.5 at. %.

The melt is next rapidly cooled and at a rate of at least about $10^{3}$° C./sec. to form a solid body, the principal phase of which is of the $L1_2$ type crystal structure in either its ordered or disordered state. Thus, although the rapidly solidified solid body will principally have the same crystal structure as the preselected intermetallic phase, i.e., the $L1_2$ type, the presence of other phases, e.g., borides, is possible. Since the cooling rates are high, it is also possible that the crystal structure of the rapidly solidified solid will be disordered, i.e., the atoms will be located at random sites on the crystal lattice instead of at specific periodic positions on the crystal lattice as is the case with ordered solid solutions.

There are several methods by which the requisite large cooling rates may be obtained, e.g., splat cooling. A preferred laboratory method for obtaining the requisite cooling rates is the chill-block melt spinning process.

Briefly and typically, in the chill-block melt spinning process molten metal is delivered from a crucible through a nozzle, usually under the pressure of an inert gas, to form a free-standing stream of liquid metal or a column of liquid metal in contact with the nozzle. The stream of liquid metal is then impinged onto or otherwise placed in contact with a rapidly moving surface of a chill-block, i.e., a cooling substrate, made of a material such as copper.

The material to be melted can be delivered to the crucible as separate solids of the elements required. They can then be melted therein by means such as an induction coil placed around the crucible. Alternatively, a "master alloy" can first be made, comminuted, and the comminuted particles placed in the crucible.

When the liquid melt from the crucible contacts the cold chill-block, it cools rapidly, from about $10^{3}$° C./sec to $10^{7}$° C./sec., and solidifies in the form of a continuous length of a thin ribbon whose width is considerably larger than its thickness. A more detailed teaching of the chill-block melt spinning process may be found, for example, in U.S. Pat. Nos. 2,825,108, 4,221,257, and 4,282,921 which are herein incorporated by reference.

The following examples are provided by way of illustration and not by limitation to further teach the novel method of the invention and illustrate its many advantageous attributes:

EXAMPLE 1

A heat of a master composition corresponding to about 3 atomic parts nickel to 1 atomic part aluminum was prepared, comminuted, and about 60 grams of the pieces were delivered into an alumina crucible of a chill-block melt spinning apparatus. The composition had the formula:

$$(Ni_{0.75}Al_{0.25})_{99}B_1.$$

The crucible terminated in a flat-bottomed exit section having a slot 0.25 inches (6.35 mm) by 25 thousandth of an inch (0.635 mm) therethrough. A chill block, in the form of a wheel having faces 10 inches (25.4 cm) in diameter with a (rim) thickness of 1.5 inches (3.8 cm), made of H-12 tool steel, was oriented vertically so that the rim surface could be used as the casting (chill) surface when the wheel was rotated about a horizontal axis passing through the centers of and perpendicular to the wheel faces. The crucible was placed in a vertically up orientation and brought to within about 1.2 to 1.6 mils (30–40$\mu$) of the casting surface with the 0.25 inch length dimension of the slot oriented perpendicular to the direction of rotation of the wheel.

The wheel was rotated at 1200 rpm. The melt was heated to between about 1350° and 1450° C. The melt was ejected as a rectangular stream onto the rotating chill surface under the pressure of argon at about 1.5 psi to produce a long ribbon which measured from about 40–70$\mu$ in thickness by about 0.25 inches in width.

The ribbon was tested for bend ductility and a value of 1.0 was found. This value of bend ductility designates that the ribbon can be bent fully to 180° without fracture.

EXAMPLE 2

The procedure of Example 1 was repeated using the equipment used as described in Example 1 to prepare a master heat of the boron doped nominal $Ni_3Al$ composition but one which was modified to the following composition:

$$(Ni_{0.75}Al_{0.20}Ti_{0.05})_{99}B_1.$$

This alloy was designated Alloy 92.

The melt was cast as also described in Example 1.

Ribbons were cast from the heat as also described in Example 1. The ribbons were tested for bend ductility and a value of 0.04 was found for the ribbon thus prepared. This value of bend ductility was calculated by dividing the ribbon thickness by the bend radius at which the ribbon fractures.

EXAMPLES 3 THROUGH 12

Ten additional heats constituting Alloys 96, 101, 111 through 117 and 125 were prepared having the compositions as set forth in Table I below. These heats were prepared in the manner described with reference to the first example described above and were tested for bend ductility in the same manner as disclosed in Example 2. The values for bend ductility which were obtained are listed in Table I.

It was also found that there is a correlation between the full bend ductility (bend ductility = 1.0) of the samples which were prepared and the formation of an equiaxed configuration in the crystallographic structure which was formed. The Table indicates also those samples for which an equiaxed format was found and also those for which the non-equiaxed format was found.

TABLE I

| Example | Alloy | Composition Formula | Bend Ductility | Crystallographic Structure |
|---|---|---|---|---|
| 2 | 92 | $(Ni_{0.75}Al_{0.20}Ti_{0.05})_{99}B_1$ | 0.04 | — |
| 3 | 96 | $[(Ni_{0.75}Al_{0.25})_{0.98}Mo_{0.02}]_{99}B_1$ | 0.06 | N |
| 4 | 111 | $(Ni_{0.75}Al_{0.20}Ta_{0.05})_{99}B_1$ | 0.03 | N |
| 5 | 112 | $(Ni_{0.75}Al_{0.20}Nb_{0.005})_{99}B_1$ | 0.02 | N |
| 6 | 113 | $(Ni_{0.75}Al_{0.20}V_{0.05})_{99}B_1$ | 1.0 | E |

TABLE I-continued

| Example | Alloy | Composition Formula | Bend Ductility | Crystallographic Structure |
|---|---|---|---|---|
| 7 | 114 | $(Ni_{0.75}Al_{0.20}Si_{0.05})_{99}B_1$ | 1.0 | E |
| 8 | 115 | $(Ni_{0.65}Fe_{0.10}Al_{0.25})_{99}B_1$ | 0.9 | N |
| 9 | 116 | $(Ni_{0.65}Mn_{0.10}Al_{0.25})_{99}B_1$ | 0.04 | — |
| 10 | 117 | $(Ni_{0.70}Cr_{0.05}Al_{0.25})_{99}B_1$ | 0.06 | N |
| 11 | 118 | $[(Ni_{0.75}Al_{0.25})Re_{0.03}]_{99}B_1$ | 0.1 | — |
| 12 | 101 | $(Ni_{0.70}Co_{0.05}Al_{0.25})_{99}B_1$ | 1.0 | E |

E designates equiaxed;
N designates nonequiaxed

As is evident from the results listed in Table I of all the compositions evaluated in which an element was substituted for nickel, only the substitution of cobalt resulted in a composition which had the equiaxed structure and full bend ductility.

EXAMPLES 13–15

Three additional master heats were prepared using the procedure as described in Example 1. The compositions of the three heats of these examples are given in the attached Table II for the respective examples.

The samples prepared in this manner were also tested for full bend ductility and the results are also included in Table II below. Further, the structure was determined and the Table lists the structure in terms of whether it is equiaxed (E) or non-equiaxed (N).

TABLE II

| Example | Composition Formula | Bend Ductility | Crystallographic Structure |
|---|---|---|---|
| 12 | $(Ni_{0.70}Co_{0.05}Al_{0.25})_{99}B_1$ | 1.0 | Equiaxed |
| 13 | $(Ni_{0.65}Co_{0.10}Al_{0.25})_{99}B_1$ | 1.0 | Equiaxed |
| 14 | $(Ni_{0.55}Co_{0.20}Al_{0.25})_{99}B_1$ | 1.0 | Nonequiaxed |
| 15 | $(Ni_{0.45}Co_{0.30}Al_{0.25})_{99}B_1$ | 1.0 | Nonequiaxed |

The ribbons from these Examples were tested in tension without any preparation. The resulting 0.2% offset yield strength (0.2% flow stress) and the ductility (strain to failure after yield (i.e., total plastic strain $\epsilon_p$) are shown in FIG. 2 as a function of the atomic percent concentration of the cobalt in the composition. Each circle and triangle on FIGS. 2 and 3 represents an experimentally determined data point.

The total plastic strains reported in FIG. 2 should be regarded as minimum material properties since the thin ribbons are largely susceptible to premature failure induced by surface defects. Thus, the total plastic strain (ductility) would be expected to be much higher for bulk material in which surface defects will play a much less influential role. In fact, although not done for the ribbons of Examples 12–15, the apparent ductility of ribbon-like specimens can generally be increased by mechanical polishing of either the flat width surfaces or of the edges, or both, to remove surface and near-surface defects and asperities.

The improved ductility of the nickel aluminide modified with boron and the quaternary cobalt additive when processed by the method of the present invention may be tested by the 180° reverse bend test wherein the ribbons are sharply bent 180° without the use of mandrels or guides.

Samples of the ribbons prepared as described in Examples 12–15 above were subjected to heat treatment at 1100° C. for two hours. The tests conducted on the strip prior to the heat treatment were performed again on samples of the strip which had been subjected to the heat treatment. The results obtained from these tests are plotted in FIG. 3. Referring now to FIG. 3, it is evident that there has been a reduction in the values on the ordinate scale. The ordinate of FIG. 3 is approximately 40% of the scale shown in FIG. 2. The abscissa which shows the concentration of the cobalt quaternary additive in weight percent is not changed and is the same in FIG. 3 as it is in FIG. 2. As is evident from FIG. 3, an annealed tri-nickel aluminide having a preferred combination of properties is one having about 10 atom percent cobalt substituent for the nickel of the aluminide.

What is claimed and sought to be protected by Letters Patent of the United States is as follows:

1. A rapidly solidified tri-nickel aluminide base alloy having a crystal structure of the $L1_2$ type, said alloy comprising a composition having the formula $$(Ni_{0.75-x}Co_xAl_{0.25})_yB_{100-y},$$

wherein the x is between 0.25 and 0.15, and the y is between 97.5 and 99.9, and said alloy having a tensile strength of at least 100 ksi.

2. The aluminide of claim 1 in which the x is between 0.03 and 0.07.

3. The aluminide of claim 1 in which x is about 0.05.

4. A rapidly solidified tri-nickel aluminide base alloy having a crystal structure of the $L1_2$ type, said alloy having the formula $$(Ni_{0.75-x}Co_xAl_{0.25})_yB_{100-y},$$

wherein x is between 0.07 and 0.15, and y is between 98.5 and 99.5, said alloy being annealed at a temperature of about 1100° C. and having a ductility greater than 5%, and said alloy having a tensile strength of at least 100 ksi.

5. The aluminide of claim 4 in which x is between 0.08 and 0.12.

6. The aluminide of claim 4 in which x is about 0.10.

7. The aluminide of claim 1 in which the y is between 98.5 and 99.5.

8. The aluminide of claim 1 in which the y is about 99.0.

9. The aluminide of claim 4 in which x is between 0.03 and 0.07.

10. The aluminide of claim 4 in which x is between 0.025 and 0.15.

* * * * *